US005544430A

United States Patent [19]

Jacko

[11] Patent Number: 5,544,430

[45] Date of Patent: Aug. 13, 1996

[54] ATHLETIC SHOE COVER AND ANKLE SUPPORT COMBINATION

[75] Inventor: Joseph G. Jacko, Dallas, Tex.

[73] Assignee: Jaggo, Inc., Dallas, Tex.

[21] Appl. No.: 216,178

[22] Filed: Mar. 22, 1994

[51] Int. Cl.[6] ..... A43B 5/00; A43B 5/18; A43B 7/20

[52] U.S. Cl. ..... 36/7.1 R; 36/9 R; 36/89; 36/100; 36/101; 36/114

[58] Field of Search ..... 36/7.1 R, 7.2, 36/9 R, 88, 89, 100, 101, 114, 1.5, 2.0

[56] References Cited

U.S. PATENT DOCUMENTS

| | | | |
|---|---|---|---|
| 1,258,024 | 3/1918 | Laybourn | 36/7.1 R |
| 2,420,618 | 5/1947 | Rabinovitz | 36/2 R |
| 3,477,147 | 11/1969 | Bauer | 36/2 R |
| 4,411,077 | 10/1983 | Slavitt | 36/89 |
| 4,621,648 | 11/1986 | Ivany | 36/89 |
| 4,642,914 | 2/1987 | Caldeira | 36/50.1 |
| 4,649,939 | 3/1987 | Curtis | 36/89 |
| 4,665,633 | 5/1987 | Edgerton | 36/7.1 R |
| 4,713,895 | 12/1987 | Vallieres | 36/7.1 R |
| 4,864,741 | 9/1989 | Beauchemin | 36/89 |
| 5,070,630 | 12/1991 | Edmundson | 36/110 |
| 5,144,759 | 9/1992 | Mascotte | 36/7.1 R |
| 5,165,182 | 11/1992 | Michael | 36/7.1 R |
| 5,172,493 | 12/1992 | Diaz | 36/2 R |
| 5,176,624 | 1/1993 | Kuehnreich | 36/101 |
| 5,251,386 | 10/1993 | Diaz | 36/2 R |
| 5,311,676 | 5/1994 | Hughes et al. | 36/7.1 R |

*Primary Examiner*—Paul T. Sewell
*Assistant Examiner*—Marie Denise Patterson
*Attorney, Agent, or Firm*—Harris, Tucker & Hardin, P.C.

[57] ABSTRACT

The present invention relates to a shoe cover that can be attached to a selected athletic shoe to provide an improved appearance of the upper portion of the shoe. The lower edge of the shoe cover attaches to the bottom of the shoe upper or to the side of the sole portion, so the bottom surface of the sole is not restricted. The top of the cover is retained tightly against the top of the shoe upper to give the cover a snug fit against the selected shoe. The shoe cover also carries one or more ankle supporting straps that are positioned near the wear's ankle when the shoe cover is installed on the shoe. The straps can be wrapped around the user's ankle where they are held closed with fasteners. Thus, the ankle support straps do not require that a separate sock element be worn under the shoe or that the straps be permanently attached to the shoe. Therefore, the user is able to have a shoe that looks new and that coordinates with his uniform, and the user has added ankle support during peak competition performances.

18 Claims, 3 Drawing Sheets

ATHLETIC SHOE COVER AND ANKLE SUPPORT COMBINATION

FIELD OF THE INVENTION

The present invention relates to a shoe cover for athletic shoes, and more particularly to a shoe cover that substantially encloses the upper portion of an athletic shoe and that includes an ankle supporting member to prevent injury.

BACKGROUND OF THE INVENTION

Modern athletic shoes have evolved into highly specialized sporting equipment. The shoe upper can be made of natural or man-made material, but in either case, the upper must be adapted to fit snugly against the users foot for a proper fit. Some athletic shoes have an upper portion that also encloses at least a portion of the user's ankle in an effort to support the ankle during the athletic activity. The upper portion is also the most visible part of the shoe, and it often functions as part of the user's uniform.

The sole of the shoe is usually made of a resilient, shock absorbing material. The bottom surface of the sole is manufactured with specialized features that provide optimum traction for a particular sport or climate conditions. Thus, it is important that the bottom portion of the sole remain fully exposed.

Because modem athletic shoes are highly specialized, they are also expensive, so athletes frequently practice in the same shoes they wear during competition. The athletes may try to clean the shoes before the competition, but soil and grass stains are difficult to remove. Washing machines have not been found to be effective in cleaning shoes. Thus, the athletes, who generally have uniforms worn only during competition, must wear their stained shoes during competition. In some sports, and in particular high school football, the athletes use colored tape to improve the appearance of their shoes and to coordinate the shoe color with their uniform. Some athletes use white tape to cover their shoe, and then paint the tape to achieve the desired color. However, the repeated application of tape can damage the shoe. The tape may interfere with traction if it covers the bottom of the sole, and it makes access to the wear's ankle difficult in case of injury.

In an effort to protect athletic shoes, shoe covers have been developed that substantially cover the shoe upper portion. For example, U.S. Pat. Nos. 4,713,895 and 5,144,759 disclose shoe covers for use on athletic shoes to prevent the underlying shoe from getting wet during poor weather. However, athletic shoes eventually become soiled and stained with repeated use, even in dry conditions. In addition, some shoe covers partially enclose part of the bottom surface of the sole, so the covers are not suited for use on athletic shoes.

Many athletic shoes attempt to provide some ankle support. However, in rigorous activities such as football, additional support is often needed to prevent ankle injury. Prior ankle supports were disclosed in U.S. Pat. Nos. 4,922,630 and 5,016,623. The prior art ankle supports generally attach to the shoe or to a sock-like member that is worn by the user to ensure proper placement of the ankle supporting straps and to maintain the positions of the straps during use. However, if the ankle support is permanently attached to the shoe, it detracts from the appearance of the shoe and must be used each time the user wears the shoe. Ankle supporting devices that include a sock-like member to be worn inside the user's shoe are uncomfortable and affect the fit of the shoe.

SUMMARY OF THE INVENTION

The present invention relates to a shoe cover that can be attached to an athletic shoe in a position that substantially covers the shoe upper to improve the appearance of the shoe. The bottom portion of the shoe cover is fastened to the shoe without covering the bottom surface of the sole, and the top portion is held closed with a retainer that pulls the cover tightly against the shoe upper. The shoe cover can be easily removed for cleaning, and the cover can be constructed of a fabric that coordinates with the user's uniform. A slightly elastic fabric that conforms to the shape of the shoe can be used, and most observers will not recognize that a shoe cover has been placed on the shoe.

The bottom edge of the cover attaches to the bottom of the shoe upper or to the side of the sole portion. Cooperating fasteners carded by the cover and the shoe include hook and loop fasteners, snaps, or a tongue and groove fastener. The top edge of the cover is retained in place with a standard shoe-type lace or straps having hook and loop fasteners, so the cover can be pulled tightly against the shoe upper. The shoe cover can be quickly loosened and removed from the shoe in case of an ankle injury.

The shoe cover also includes one or more ankle supporting straps that surround and support the user's ankle. The straps are attached to the shoe cover, so they are automatically placed in the proper position relative to the user's ankle. The straps carry a fastener to hold themselves closed around the user's ankle. Any fastener known in the art including hook and loop fasteners, snaps, or buckles can be used. Because the ankle support straps are attached to the shoe cover, the straps do not have to be attached directly to the shoe and the user does not have to wear a separate sock-like member under the shoe.

The shoe cover is much less expensive than the athletic shoe it covers, so the user can have several covers to coordinate with different uniforms. Moreover, if a cover becomes permanently soiled or damaged, the cover can be inexpensively replaced. Thus, the user can wear the same shoe for practice and for competition.

BRIEF DESCRIPTION OF THE DRAWINGS

For a more complete understanding of the present invention, and for further details and advantages thereof, reference is now made to the following detailed description taken in conjunction with the following drawings, in which.

DETAILED DESCRIPTION OF THE DRAWINGS

Figure 1:
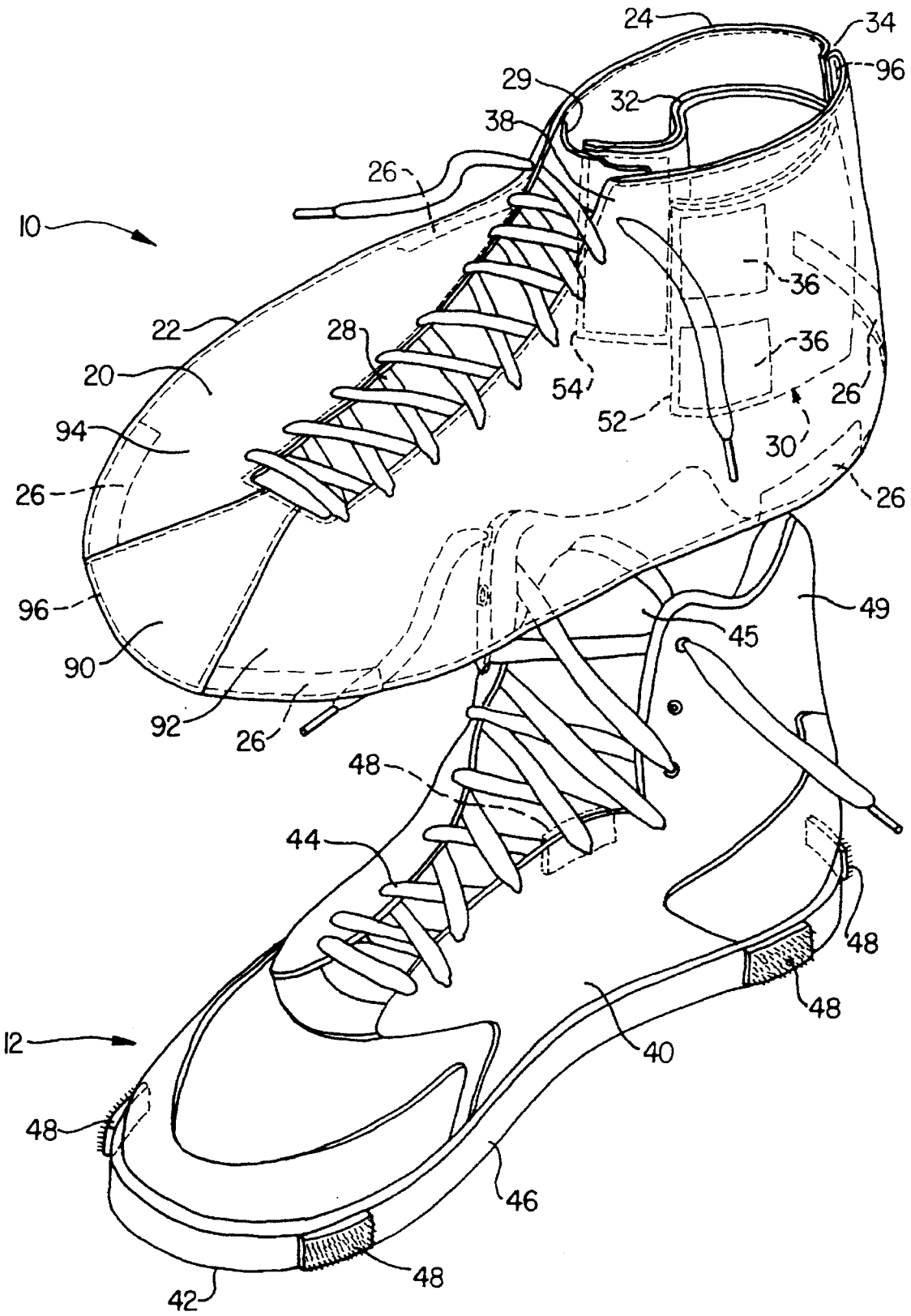
FIG. 1 is a perspective view of the shoe cover constructed in accordance with the present invention as it is positioned over a standard athletic shoe.

The present invention relates to a combination shoe cover and ankle support. Referring to FIG. 1, shoe cover 10, constructed in accordance with the present invention, is being placed over athletic shoe 12. Covering number 20 has open bottom-end 22 and open top-end 24. Fasteners 26 are attached along bottom-end 22, and retaining means 28 is carded on top-end 24. Tongue member 29 is positioned under retaining means 28 to partially close top-end 24. Ankle support means 30 incudes ankle support strap 32 attached to the rearward side 34 of covering member 20. One end of support strap 32 includes fasteners 36 that cooperate with fastener 38 disposed on the opposite end of support strap 32.

Cover 10 is adapted to be installed on a selected athletic shoe 12 having upper portion 40 and sole portion 42. Upper portion 40 is partially closed and retained on a user's foot with a standard shoe lace configuration 44 over tongue 45. Sole portion 42 includes side portion 46 and a bottom surface. Fasteners 48 are attached to side portion 46 of sole 42 to cooperate with fasteners 26 of covering number 20. Ankle portion 49 of shoe upper 40 provide support to the user's ankle.

Figure 2:
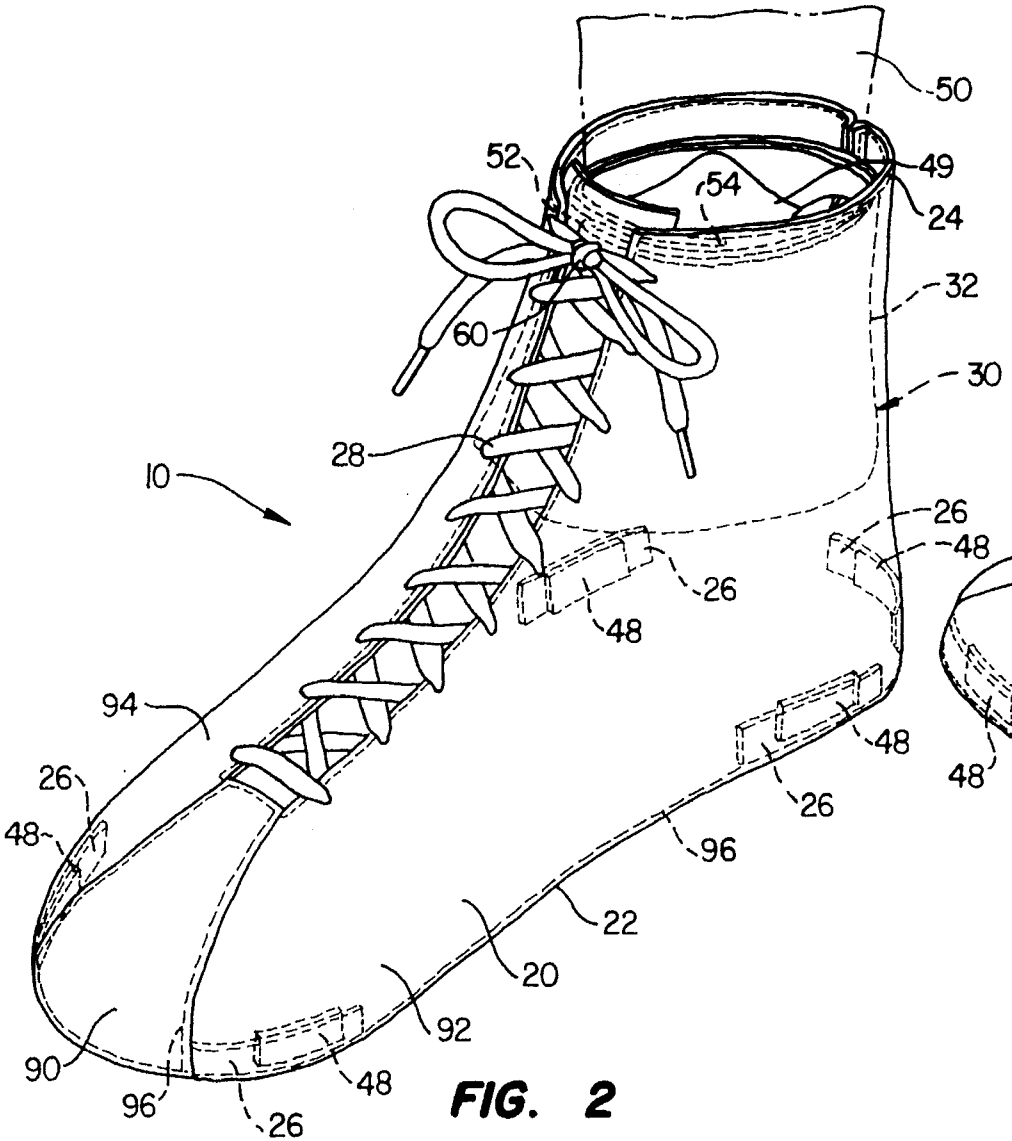
FIG. 2 is a perspective view of the shoe cover shown in FIG. 1 having been attached and retained over an athletic shoe.

Referring now to FIG. 2, shoe cover 10 has been installed on shoe 12 as worn by user 50. Fasteners 26 are cooperating with fasteners 48 of shoe 12 to securely fasten bottom-end 22 of covering member 20 to side portion 46 of sole 42. Retention means 28 has been tightened to pull covering member 20 snugly against shoe upper 40, and knot 60 prevents retention means 28 from loosening. Support strap 32 encircles shoe upper 40 near ankle portion 49, and thus, support strap 32 encircles the ankle of user 50. The opposing ends 52 and 54 of support strap 32 are overlapped near knot 60 with fasteners 36 cooperating with fastener 38 to maintain support strap 32 tightly against shoe 12.

Figure 3:
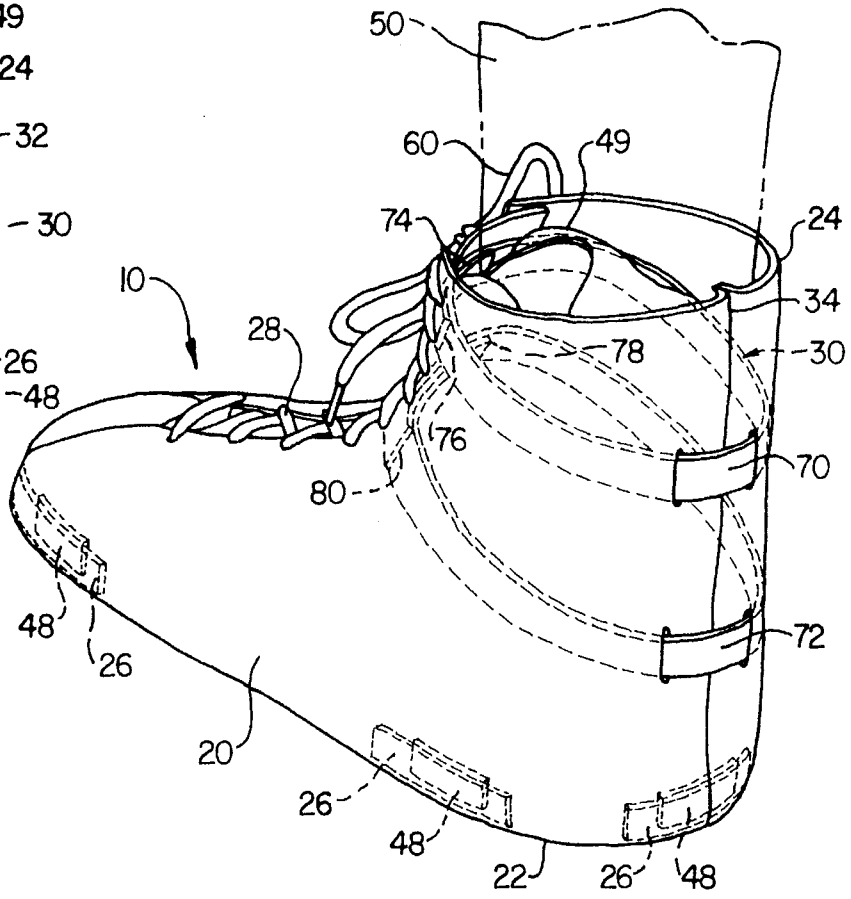
FIG. 3 is a perspective view of the shoe cover as shown in FIG. 1 having been attached and retained over an athletic shoe and with an alternative ankle support strap arrangement.

FIG. 3 is a perspective view of shoe cover 10 as shown in FIG. 2 having been installed on shoe 12. However, an alternative ankle support means 30 is shown. Instead of a single, relatively wide support strap 32, ankle support means 30 comprises an upper support strap 70 and a lower strap 72. Support straps 70 and 72 are attached to rearward side 34 of covering number 20. Opposing ends 74 and 76 of upper support strap 70 and opposing ends 78 and 80 of lower support strap 72 overlap and are held closed around the ankle of user 50 by cooperating fasteners carried by the straps. The cooperating fasteners are equivalent to fasteners 36 and 38 used on strap 32.

Referring now to FIGS. 1–3, covering member 20 is constructed of a soft, pliable material that will conform to the overall shape of the selected athletic shoe 12. Moreover, covering number 20 is preferably constructed of multiple gores to provide a more conforming shape, including the use of a wedge shaped gore 90 positioned between side gores 92 and 94 to provide a rounded toe portion for covering member 20. Preferably, the edges of covering member 20 and the seams between gores 90, 92, and 94 are hemmed as referenced at 96 to prevent the material from unraveling and to improve the overall appearance of covering member 20. The material used to construct covering member 20 must be strong enough to allow the attachment of fasteners 26, retention means 28, and support means 30. If the material is slightly elastic, covering member will snugly conform to the shape of upper portion 40 when retention means 28 is tightened. Finally, the material used to construct covering member 20 can be porous to allow the fabric to breathe, or the fabric could be water repellent to keep shoe 12 dry.

Figure 5:
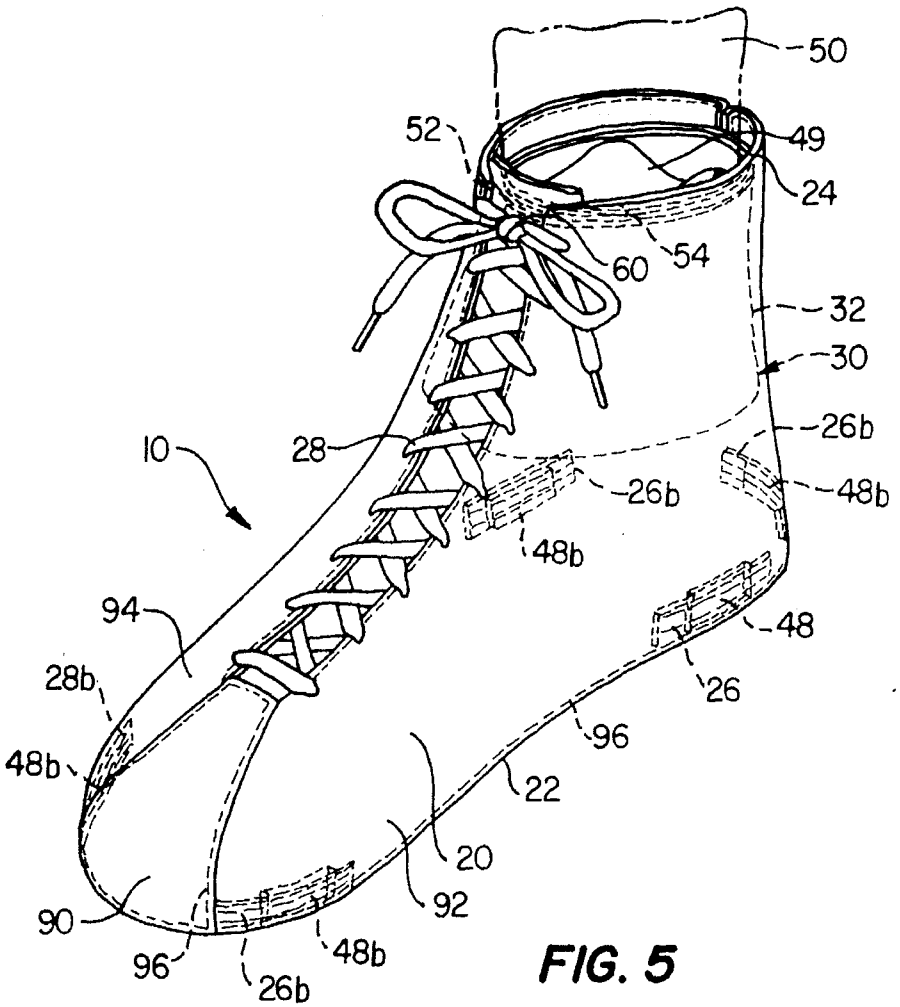
FIGS. 4 and 5 provide perspective views of alternative embodiments of the shoe cover.
Figure 4:
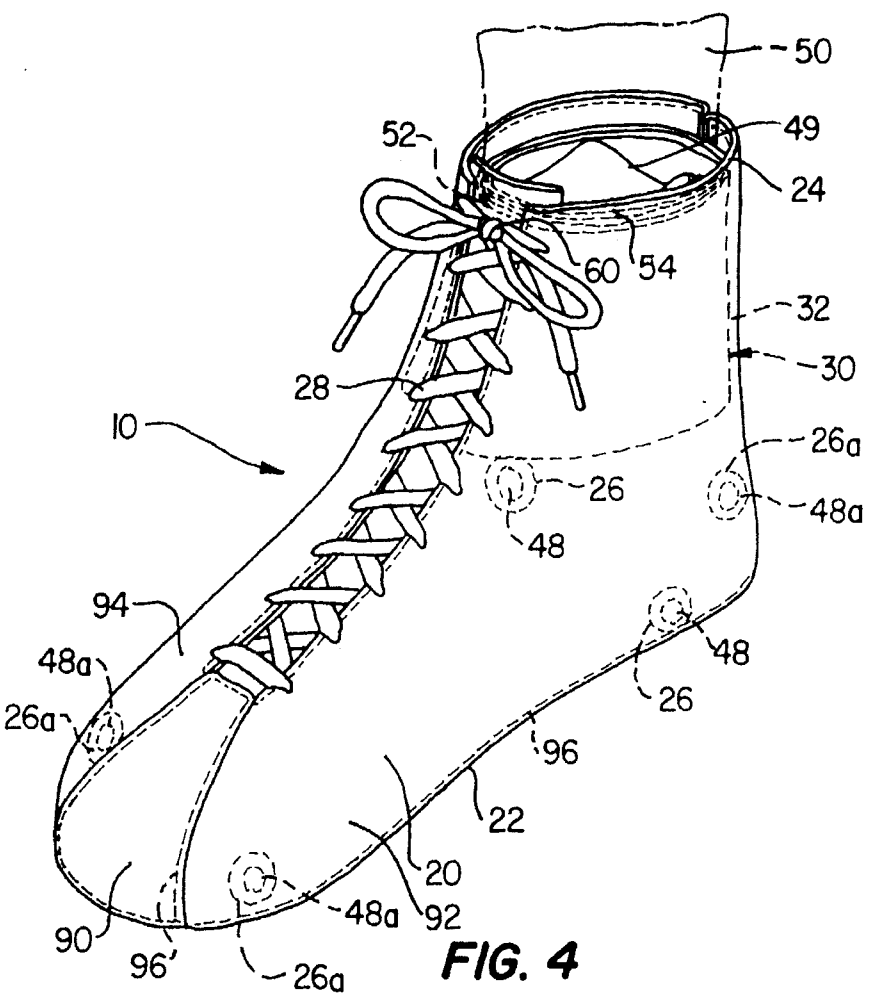

Bottom end 22 of covering member 20 is removably attached to athletic shoe 12 with cooperating fasteners member 26 and 48. Cooperating fasteners 26 and 48 are depicted in FIGS. 1–3 as traditional hook and loop fasteners, but any cooperating fastening means known in the art that allow removable attachment could be used. For example, conventional snap fasteners could be incrementally spaced along side portion 46 of sole 42 with cooperating snap fasteners **26*a*, 48*a* attached along bottom end 22 of covering member 20. In a similar fashion, cooperating tongue and grove fasteners 26*b*, 46*b* could be used. These embodiments are shown in FIGS. 4 and 5 respectively. In particular, covering member 20 could include a suitable material, such as O-ring material, sewn within the hem 96 along bottom end 22 that could be received and retained within a groove formed along side portion 46 of sole 42. Alternatively, covering member 20 could form a groove that receives an extension or tongue formed on shoe 12. The fasteners used to removably attach bottom end 22 of covering member 20 to shoe 12 can provide a continuous seal around the periphery of shoe 12 for weather protection, or the fasteners could be spaced apart as shown in FIGS. 1–3 to improve the ventilation between the shoe cover 10 and shoe 12**.

Retention means 28 is shown as a standard shoe-type lace passing through holes along a portion of top end 24 of covering member 20. Preferably, the incrementally spaced holes are lined with eyelets or grommets to protect the fabric. Use of a standard shoe type lace configuration allows a user to close and retain top end 24 of covering member 20 around the top portion of shoe upper 40 and around the ankle of user 50. In addition, retention means 28 allows the user to pull covering member tightly against shoe upper 40 because loose material could hinder athletic performance. Finally, a shoe lace type retention means creates the overall appearance of a shoe upper, so an observer will not know the user is wearing a shoe cover. Retention means 28 includes other configurations. For example, it is well known in the art that two or more straps can be used on a conventional athletic shoe in place of standard shoe-type lace retention means, and the straps could be used on shoe cover 10. The straps are attached to one side of covering member 20 and can extend across top end 24 where they are inserted through slots in covering member 20. The straps are then folded back over top end 24, and a user can pull the straps through the receiving slots to tighten covering member 20 snugly against upper portion 40 of shoe 12. Each strap carries a pair of cooperating fasteners to hold the straps in place once they have been pulled tight. Hook and loop fasteners are preferred because they allow for a range of closure positions. Other retention means 28 known in the art, including zippers, snaps, and tongue-and-groove fasteners can also be used as retention means 28.

Support means 30 includes support strap 32 fastened to the rearward side 34 of covering member 20 and cooperating fasteners 36 and 38. Alternatively, supporting strap 32 as shown in FIG. 1 can be replaced with relatively thin upper and lower support strap 70 and 72. In either case, the supporting straps are attached to the rearward portion 34 of covering member 20, and they extend around shoe ankle support 49. The straps carry cooperating fastening members attached to the opposing ends of the straps, so they are referred to as self closing. Each strap is tightly closed around ankle portion 49 and the ankle of user 50 with the opposing ends of the strap overlapping in front of the user's ankle. Thus, the user can easily access the support strap fasteners to loosen or tighten the supporting straps. If the support strap is attached to the shoe in a manner that makes one side of the strap longer than the other, the coordinating strap fasteners will be on the side the user's ankle instead of the front. Access to the overlapping portions of the support straps is easier if the overlapping portion is in front of the user's ankle. If shoe 12 does not include ankle portion 49, the support straps will be in contact with the wear's ankle.

Preferably, coordinating fasteners 36 and 38 that hold the supporting straps 30, 70, and 72 closed are hook and loop fasteners, but any fastener known in the art can be used. Hook and loop fasteners can be fastened or unfastened very quickly; however, snaps, buttons, laces, or tongue-and-groove fasteners can be used. In particular, support straps 30, 70, and 72 can have a slot on one end that receives the opposing end, and the opposing end carries the cooperating fastening members. Thus, the user can tighten the strap by pulling the opposing end through the slot. Support strap 32 is preferably constructed of an elastic material that retains tension on the user's ankle once the opposing ends of support strap 32 have been fastened. Support straps 70 and 72 can be constructed of an elastic or non-elastic material since the more narrow straps conform to the contours of the user's ankle to retain tension once the opposing ends have been fastened. When a single support strap 32 is used, the strap is preferably sewn along rearward side 34 of covering member 20, but the more narrow upper and lower support straps 70 and 72 can either be sewn to covering member 20 or threaded through spaced apertures on covering member 20 as shown in FIG. 3.

Traditionally, ankle supports were either permanently affixed to a shoe, or they included a sock-like member that was worn on the user's foot under his shoe. The purpose was to ensure proper initial placement of the supporting members and to retain the supporting members in the same location. In the present invention, supporting straps 32, 70 and 72 are initially placed and then retained against the user's ankle by covering member 20. Moreover, support means 30 acts as an additional means for attaching covering member 20 to athletic shoe 12. Thus, a combination shoe cover and ankle support provides mutual benefits to both aspects.

A combination shoe cover and athletic support 10 constructed in accordance with this invention provides many benefits not found in the prior art. Initially, shoe cover 10 is relatively inexpensive when compared to the price of most athletic shoes. Thus, shoe cover 10 provides an economical alternative to buying several pairs of shoes; instead, shoe cover 10 will provide the appearance of new shoes during athletic competitions. In addition, different color shoe covers can be purchased inexpensively so that an athlete can coordinate his shoes with each competition uniform. In team sports, different team members may wear different brand of shoes causing an uneven appearance of the team uniform, but shoe cover 10 will give each player the same appearance. After each use, shoe cover 10 can be quickly and easily removed from athletic shoe 12 for cleaning. Because covering member 20 is constructed of fabric, machine washing is effective. If shoe cover 10 is permanently soiled or damaged, the shoe cover, unlike the shoe, can be inexpensively replaced. Shoe cover 10 also provides additional ankle support for the user, but the user's ankle can be quickly examined in case of an injury. Finally, each of these benefits are provided without obstructing or enclosing any portion of the bottom surface of sole 42, so athletic performance is not impeded.

Although preferred embodiments of the invention have been described in the foregoing detailed description and illustrated in the accompanying drawings, it will be understood that the invention is not limited to the embodiments disclosed but is capable of numerous rearrangements, modifications and substitutions of parts and elements without departing from the spirit of the invention. Accordingly, the present invention is intended to encompass such rearrangements, modifications and substitutions of parts or elements as fall within the scope of the invention.

I claim:

1. A combination shoe cover and ankle support for use on a selected shoe having an upper portion and a sole portion, the sole portion having a bottom surface and a side surface, the combination comprising:

(a) a covering member of pliable material generally having a shape conforming to the shape of the selected shoe when the covering material is placed thereover, the covering member having an open bottom end and an oppositely disposed open top end;

(b) a fastener attached to the covering member to removably fasten the covering member to the shoe, whereby the covering member is in a position that substantially covers the upper portion of the shoe without obstructing the bottom surface of the sole;

(c) a retention means for tightly retaining the top end of the covering member around the top of the upper portion of the shoe and around a user's ankle, the retention means adapted to pull the covering material snugly against the upper portion of the shoe; and (d) a support means for supporting the user's ankle to prevent injury, the support means attached to the covering member and comprising at least one support strap that can tightly surround and support the user's ankle, wherein the support means does not cover any portion of the bottom surface of the sole.

2. The shoe cover of claim 1 wherein the covering member is constructed of an elastic fabric.

3. The shoe cover of claim 1 wherein the second fastener is carried on the side surface of the sole of the shoe.

4. The shoe cover of claim 1 wherein the first and second fasteners comprise cooperating hook and loop fasteners.

5. The shoe cover of claim 1 wherein the first and second fasteners comprise cooperating snap fasteners.

6. The shoe cover of claim 1 wherein the first and second fasteners comprise cooperating tongue-in-groove fasteners.

7. The shoe cover of claim 1 wherein the retention means comprises a lace threaded through incrementally spaced holes on the top end of the covering member.

8. The shoe cover of claim 1 wherein each support strap of the support means is constructed of an elastic material.

9. The shoe cover of claim 1 wherein each support strap of the support means is self closing.

10. A shoe and cooperating shoe cover comprising:

(a) shoe having an upper portion and a sole portion, the sole portion having a bottom surface and a side surface;

(b) covering member of pliable material generally having a shape conforming to the shape of the selected shoe, the covering member having an open bottom end and an oppositely disposed open top end;

(c) first fastener carried by the covering member;

(d) a second fastener carried by the shoe, cooperating with the first fastener to removably fasten the bottom end of the covering member to the shoe whereby the covering member is in a position that substantially covers the upper portion of the shoe without obstructing the bottom surface of the sole;

(e) a retention means for tightly retaining the top end of the covering member around the top of the upper portion of the shoe and around a user's ankle, the retention means adapted to pull the covering material snugly against the upper portion of the shoe; and (f) support means for supporting the user's ankle, the support means attached to the covering member and comprising at least one support strap that can surround and support the user's ankle, wherein the support means does not cover any portion of the bottom surface of the sole.

11. The shoe cover of claim 10 wherein the covering member is constructed of an elastic fabric.

12. The shoe cover of claim 10 wherein the second fastener is carried on the side surface of the sole of the shoe.

13. The shoe cover of claim 10 wherein the first and second fasteners comprise cooperating hook and loop fasteners.

14. The shoe cover of claim 10 wherein the first and second fasteners comprise cooperating snap fasteners.

15. The shoe cover of claim 10 wherein the first and second fasteners comprise cooperating tongue-in-groove fasteners.

16. The shoe cover of claim 10 wherein the retention means comprises a lace threaded through incrementally spaced holes on the top end of the covering member.

17. The shoe cover of claim 10 wherein each support strap of the support means is constructed of an elastic material.

18. The shoe cover of claim 10 wherein each support strap of the support means is self closing.

* * * * *